US007864969B1

(12) United States Patent
Ma et al.

(10) Patent No.: US 7,864,969 B1
(45) Date of Patent: Jan. 4, 2011

(54) ADAPTIVE AMPLIFIER CIRCUITRY FOR MICROPHONE ARRAY

(75) Inventors: Wei Ma, San Ramon, CA (US); Ahmad Bahai, Lafayette, CA (US)

(73) Assignee: National Semiconductor Corporation, Santa Clara, CA (US)

( * ) Notice: Subject to any disclaimer, the term of this patent is extended or adjusted under 35 U.S.C. 154(b) by 1256 days.

(21) Appl. No.: 11/307,930

(22) Filed: Feb. 28, 2006

(51) Int. Cl.
*H04R 3/00* (2006.01)

(52) U.S. Cl. ..... 381/92; 381/71.11

(58) Field of Classification Search ..... 381/7, 381/10, 22, 16, 94.1–94.9, 92, 71.11, 71.1, 381/120; 342/357, 378–380, 16, 6; 455/306; 701/213

See application file for complete search history.

(56) References Cited

U.S. PATENT DOCUMENTS 3,455,148 A * 7/1969 Ostrander et al. ..... 73/654
5,239,579 A * 8/1993 Schuh ..... 379/395
5,303,307 A 4/1994 Elko et al.
5,473,684 A 12/1995 Bartlett et al.
5,586,191 A 12/1996 Eklo et al.
5,990,746 A * 11/1999 Samuels ..... 330/285
6,320,968 B1 * 11/2001 Linder ..... 381/94.7
6,584,203 B2 6/2003 Elko et al.
7,123,727 B2 10/2006 Elko et al.
2003/0031328 A1 2/2003 Elko et al.
2003/0063759 A1 * 4/2003 Brennan et al. ..... 381/92

* cited by examiner

*Primary Examiner*—Vivian Chin
*Assistant Examiner*—Leshui Zhang
(74) *Attorney, Agent, or Firm*—Vedder Price P.C.

(57) ABSTRACT

Adaptive amplifier circuitry for a microphone array with alternative operating modes. In one mode, background noise is reduced when the speaker is in a near field position and a relatively quiet environment. In another mode, the microphone signals are amplified, with speech being boosted more than background noise, when the speaker moves from a near field position to a far field position.

32 Claims, 2 Drawing Sheets

ADAPTIVE AMPLIFIER CIRCUITRY FOR MICROPHONE ARRAY

BACKGROUND OF THE INVENTION

1. Field of the Invention

The present invention relates to microphone arrays and in particular, to amplifier circuits for differential microphone arrays.

2. Description of the Related Art

With the seemingly ever increasing popularity of cellular telephones, as well as personal digital assistances (PDAs) providing voice recording capability, it has become increasingly important to have noise canceling microphones capable of operating in noisy acoustic environments. Further, even in the absence of excessive background noise, noise canceling microphones are nonetheless highly desirable for certain applications, such as speech recognition devices and high fidelity microphones for studio and live performance uses.

Such microphones are often referred to as pressure gradient or first order differential (FOD) microphones, and have a diaphragm which vibrates in accordance with differences in sound pressure between its front and rear surfaces. This allows such a microphone to discriminate against airborne and solid-borne sounds based upon the direction from which such noise is received relative to a reference axis of the microphone. Additionally, such a microphone can distinguish between sound originating close to and more distant from the microphone.

For the aforementioned applications, so called close-talk microphones, i.e., microphones which are positioned as close to the mouth of the speaker as possible, are seeing increasing use. In particular, multiple microphones are increasingly configured in the form of a close-talking differential microphone array (CTDMA), which inherently provide low frequency far field noise attenuation. Accordingly, a CTDMA advantageously cancels far field noise, while effectively accentuating the voice of the close talker, thereby spatially enhancing speech quality while minimizing background noise. (Further discussion of these types of microphones can be found in U.S. Pat. Nos. 5,473,684, and 5,586,191, the disclosures of which are incorporated herein by reference.)

While a CTDMA generally works well for its intended purpose, its differential connection, i.e., where one microphone signal is subtracted from another, will typically boost the internal noise. The action of the differential summing, i.e., signal subtraction, generally increases, e.g., doubles, the internal noise. Additionally, following this differential summation, the signal needs to be amplified, e.g., 10-20 decibels, which also increases the internal circuit noise.

Further, a CTDMA is sensitive to matching. For example, if the microphone and preamplifier are not properly matched, the far field noise will not be cancelled, and the near, or close, field pattern may be altered.

Other issues include near field distance adaptation where within a close talking distance, e.g., within 75 millimeters, the high pass filtering effect can vary and must be adaptively compensated. (See U.S. Pat. No. 5,586,191.) Additionally, when the talker moves from a near field to a far field location, the desired speech may be cancelled. Accordingly, the differential microphone array needs to be adaptive to form a beam forming array such as a delay-sum array.

SUMMARY OF THE INVENTION

In accordance with the presently claimed invention, adaptive amplifier circuitry is provided for a microphone array with alternative operating modes. In one mode, background noise is reduced when the speaker is in a near field position and a relatively quiet environment. In another mode, the microphone signals are amplified, with speech being boosted more than background noise, when the speaker moves from a near field position to a far field position.

In accordance with one embodiment of the presently claimed invention, adaptive amplifier circuitry for a microphone array includes input adaptive filter circuitry, signal combining circuitry, output adaptive filter circuitry and feedback control circuitry. The input adaptive filter circuitry is responsive to one or more input control signals and a plurality of analog microphone signals by providing a like plurality of filtered input signals. The signal combining circuitry is coupled to the input adaptive filter circuitry and responsive to one or more combining control signals and the plurality of filtered input signals by providing a resultant signal selectively corresponding to one of: a sum of at least a portion of the plurality of filtered input signals; and a difference between at least first and second ones of the plurality of filtered input signals. The output adaptive filter circuitry is coupled to the signal combining circuitry and responsive to one or more output control signals and the resultant signal by providing an output signal. The feedback control circuitry is coupled to the input adaptive filter circuitry, the signal combining circuitry and the output adaptive filter circuitry, and responsive to at least one of the plurality of filtered input signals and the output signal by providing the one or more input control signals, the one or more combining control signals and the one or more output control signals.

In accordance with another embodiment of the presently claimed invention, adaptive amplifier circuitry for a microphone array includes input adaptive filter means, signal combiner means, output adaptive filter means and feedback controller means. The input adaptive filter means is for receiving one or more input control signals and in response thereto receiving and filtering a plurality of analog microphone signals to provide a like plurality of filtered input signals. The signal combiner means is for receiving one or more combining control signals and in response thereto receiving and combining the plurality of filtered input signals to provide a resultant signal selectively corresponding to one of: a sum of at least a portion of the plurality of filtered input signals; and a difference between at least first and second ones of the plurality of filtered input signals. The output adaptive filter means is for receiving one or more output control signals and in response thereto receiving and filtering the resultant signal to provide an output signal. The feedback controller means is for receiving and processing at least one of the plurality of filtered input signals and the output signal to provide the one or more input control signals, the one or more combining control signals and the one or more output control signals.

In accordance with another embodiment of the presently claimed invention, adaptive amplifier circuitry for a microphone array includes input adaptive processing circuitry, output adaptive processing circuitry and feedback control circuitry. The input adaptive processing circuitry is responsive to one or more input control signals and a plurality of analog microphone signals by providing a plurality of input processed signals corresponding to the plurality of analog microphone signals, and an intermediate processed signal selectively corresponding to one of: a sum of at least a portion of the plurality of input processed signals; and a difference between at least first and second ones of the plurality of input processed signals. The output adaptive processing circuitry is coupled to the input adaptive processing circuitry and responsive to one or more output control signals and the intermediate processed signal by providing an output processed signal. The feedback control circuitry is coupled to the input and output adaptive processing circuitries, and responsive to at least one of the plurality of input processed signals and the output processed signal by providing the one or more input control signals and the one or more output control signals.

In accordance with another embodiment of the presently claimed invention, adaptive amplifier circuitry for a microphone array includes input adaptive processor means, output adaptive processor means and feedback controller means. The input adaptive processor means is for receiving one or more input control signals and in response thereto receiving and processing a plurality of analog microphone signals to provide a plurality of input processed signals corresponding to the plurality of analog microphone signals, and an intermediate processed signal selectively corresponding to one of: a sum of at least a portion of the plurality of input processed signals; and a difference between at least first and second ones of the plurality of input processed signals. The output adaptive processor means is for receiving one or more output control signals and in response thereto receiving and processing the intermediate processed signal to provide an output processed signal. The feedback controller means is for receiving and processing at least one of the plurality of input processed signals and the output processed signal to provide the one or more input control signals and the one or more output control signals.

In accordance with another embodiment of the presently claimed invention, adaptive amplifier circuitry for a microphone array includes input adaptive filter circuitry, signal combining circuitry, output adaptive filter circuitry, signal selection circuitry and feedback control circuitry. The input adaptive filter circuitry is responsive to one or more input control signals and a plurality of analog microphone signals by providing a like plurality of filtered input signals. The signal combining circuitry is coupled to the input adaptive filter circuitry and responsive to one or more combining control signals and the plurality of filtered input signals by providing a resultant signal selectively corresponding to one of: a sum of at least a portion of the plurality of filtered input signals; and a difference between at least first and second ones of the plurality of filtered input signals. The output adaptive filter circuitry is coupled to the signal combining circuitry and responsive to one or more output control signals and the resultant signal by providing an output signal. The signal selection circuitry is coupled to the input adaptive filter circuitry and the output adaptive filter circuitry, and responsive to one or more selection control signals by conveying, as a selected signal, one of: the output signal; a first one of the plurality of filtered input signals; and at least a second one of the plurality of filtered input signals. The feedback control circuitry is coupled to the input adaptive filter circuitry, the signal combining circuitry, the output adaptive filter circuitry and the signal selection circuitry, and responsive to the selected signal by providing the one or more input control signals, the one or more combining control signals and the one or more output control signals.

In accordance with another embodiment of the presently claimed invention, adaptive amplifier circuitry for a microphone array includes input adaptive filter means, signal combiner means, output adaptive filter means, signal selector means and feedback controller means. The input adaptive filter means is for receiving one or more input control signals and in response thereto receiving and filtering a plurality of analog microphone signals to provide a like plurality of filtered input signals. The signal combiner means is for receiving one or more combining control signals and in response thereto receiving and combining the plurality of filtered input signals to provide a resultant signal selectively corresponding to one of: a sum of at least a portion of the plurality of filtered input signals; and a difference between at least first and second ones of the plurality of filtered input signals. The output adaptive filter means is for receiving one or more output control signals and in response thereto receiving and filtering the resultant signal to provide an output signal. The signal selector means is for receiving one or more selection control signals and in response thereto conveying, as a selected signal, one of: the output signal; a first one of the plurality of filtered input signals; and at least a second one of the plurality of filtered input signals. The feedback controller means is for receiving the selected signal and in response thereto providing the one or more input control signals, the one or more combining control signals and the one or more output control signals.

In accordance with another embodiment of the presently claimed invention, adaptive amplifier circuitry for a microphone array includes input adaptive processing circuitry, output adaptive processing circuitry, signal selection circuitry and feedback control circuitry. The input adaptive processing circuitry is responsive to one or more input control signals and a plurality of analog microphone signals by providing a plurality of input processed signals corresponding to the plurality of analog microphone signals, and an intermediate processed signal selectively corresponding to one of: a sum of at least a portion of the plurality of input processed signals; and a difference between at least first and second ones of the plurality of input processed signals. The output adaptive processing circuitry is coupled to the input adaptive processing circuitry and responsive to one or more output control signals and the intermediate processed signal by providing an output processed signal. The signal selection circuitry is coupled to the input and output adaptive processing circuitries, and responsive to one or more selection control signals by conveying, as a selected signal, one of: the output processed signal; a first one of the plurality of input processed signals; and at least a second one of the plurality of input processed signals. The feedback control circuitry is coupled to the input and output adaptive processing circuitries and the signal selection circuitry, and responsive to the selected signal by providing the one or more input control signals and the one or more output control signals.

In accordance with another embodiment of the presently claimed invention, adaptive amplifier circuitry for a microphone array includes input adaptive processor means, output adaptive processor means, signal selector means and feedback controller means. The input adaptive processor means is for receiving one or more input control signals and in response thereto receiving and processing a plurality of analog microphone signals to provide a plurality of input processed signals corresponding to the plurality of analog microphone signals, and an intermediate processed signal selectively corresponding to one of: a sum of at least a portion of the plurality of input processed signals; and a difference between at least first and second ones of the plurality of input processed signals. The output adaptive processor means is for receiving one or more output control signals and in response thereto receiving and processing the intermediate processed signal to provide an output processed signal. The signal selector means is for receiving one or more selection control signals and in response thereto conveying, as a selected signal, one of: the output processed signal; a first one of the plurality of input processed signals; and at least a second one of the plurality of input processed signals. The feedback controller means is for receiving the selected signal and in response thereto providing the one or more input control signals and the one or more output control signals.

DETAILED DESCRIPTION

The following detailed description is of example embodiments of the presently claimed invention with references to the accompanying drawings. Such description is intended to be illustrative and not limiting with respect to the scope of the present invention. Such embodiments are described in sufficient detail to enable one of ordinary skill in the art to practice the subject invention, and it will be understood that other embodiments may be practiced with some variations without departing from the spirit or scope of the subject invention.

Throughout the present disclosure, absent a clear indication to the contrary from the context, it will be understood that individual circuit elements as described may be singular or plural in number. For example, the terms "circuit" and "circuitry" may include either a single component or a plurality of components, which are either active and/or passive and are connected or otherwise coupled together (e.g., as one or more integrated circuit chips) to provide the described function. Additionally, the term "signal" may refer to one or more currents, one or more voltages, or a data signal. Within the drawings, like or related elements will have like or related alpha, numeric or alphanumeric designators. Further, while the present invention has been discussed in the context of implementations using discrete electronic circuitry (preferably in the form of one or more integrated circuit chips), the functions of any part of such circuitry may alternatively be implemented using one or more appropriately programmed processors, depending upon the signal frequencies or data rates to be processed.

Figure 1:
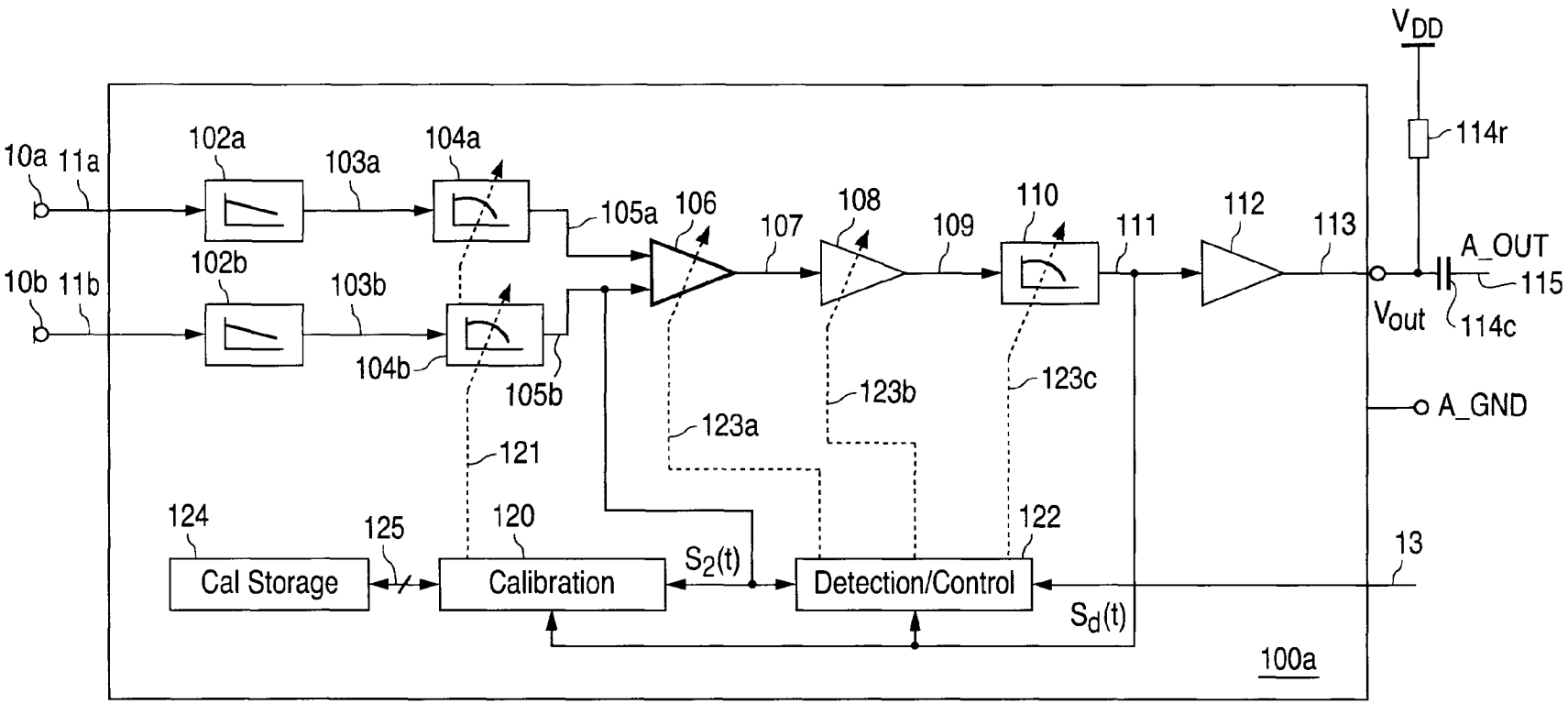
FIG. 1 is a functional block diagram of adaptive amplifier circuitry for a microphone array in accordance with one embodiment of the presently claimed invention.

Referring to FIG. 1, adaptive amplifier circuitry 100*a* for a microphone array in accordance with one embodiment of the presently claimed invention includes input adaptive filter circuitry, signal combining circuitry, output adaptive filter circuitry and feedback control circuitry, as discussed in more detail below, for processing the microphone signals 11*a* and 11*b* received from the acoustic transducers 10*a*, 10*b*, to produce the final audio output signal 113 which is high pass filtered by a shunt biasing resister 114*r* and series coupling capacitor 114*c*.

The transducer signals 11*a* and 11*b* are filtered by respective low pass pre-emphasis filters 102*a* 102*b*, following which the filtered signals 103*a*, 103*b* are matched with matching filter circuits 104*a*, 104*b* which are adaptively controlled by one or more control signals 121. The resulting signals 105*a*, 105*b* are combined in a signal combining circuit 106 which is adaptively controlled by one or more control signals 123*a*. As discussed in more detail below, this combining circuit 106 is adaptively controlled to be either a summing circuit, i.e., where the input signals 105*a*, 105*b* are summed, or a subtraction circuit in which one of the input signals 105*a*, 105*b* is subtracted from the other.

The resulting signal 107 is amplified by a variable gain amplifier circuit 108 which is adaptively controlled by one or more control signals 123*b*. The amplified signal 109 is filtered by a low pass filter circuit 110 which adaptively controlled by one or more control signals 123*c*. The filtered signal 111 is then amplified by a driver amplifier circuit 112 to produce the final audio output signal 113.

The control circuitry includes calibration circuitry 120, detection and control circuitry 122, and calibration storage circuitry 124. The calibration circuitry 120 and the detection and control circuitry 122 both receive the filtered output signal 111, as well as one of the filtered input signals 105*b*. As discussed in more detail below, based on the magnitudes of these signals 111, 105*b* as a function of time, the calibration circuitry 120 provides the adaptive control signals 121 for the matching filters 104*a*, 104*b* and the detection control circuitry 122 provides the adaptive control signals 123*a*, 123*b*, 123*c* for the combining circuit 106, variable gain amplifier circuit 108 and adaptive filter circuit 110. In accordance with one embodiment, these circuits 120, 122 operate in a primary analog manner to provide analog control signals 121, 123*a*, 123*b*, 123*c*. In accordance with an alternative embodiment, these circuits 120, 122 operate in a primarily digital manner by converting (e.g., internally) the analog signals 111, 105*b* to digital signals and providing digital control signals 121, 123*a* 123*b*, 123*c*.

Figure 2:
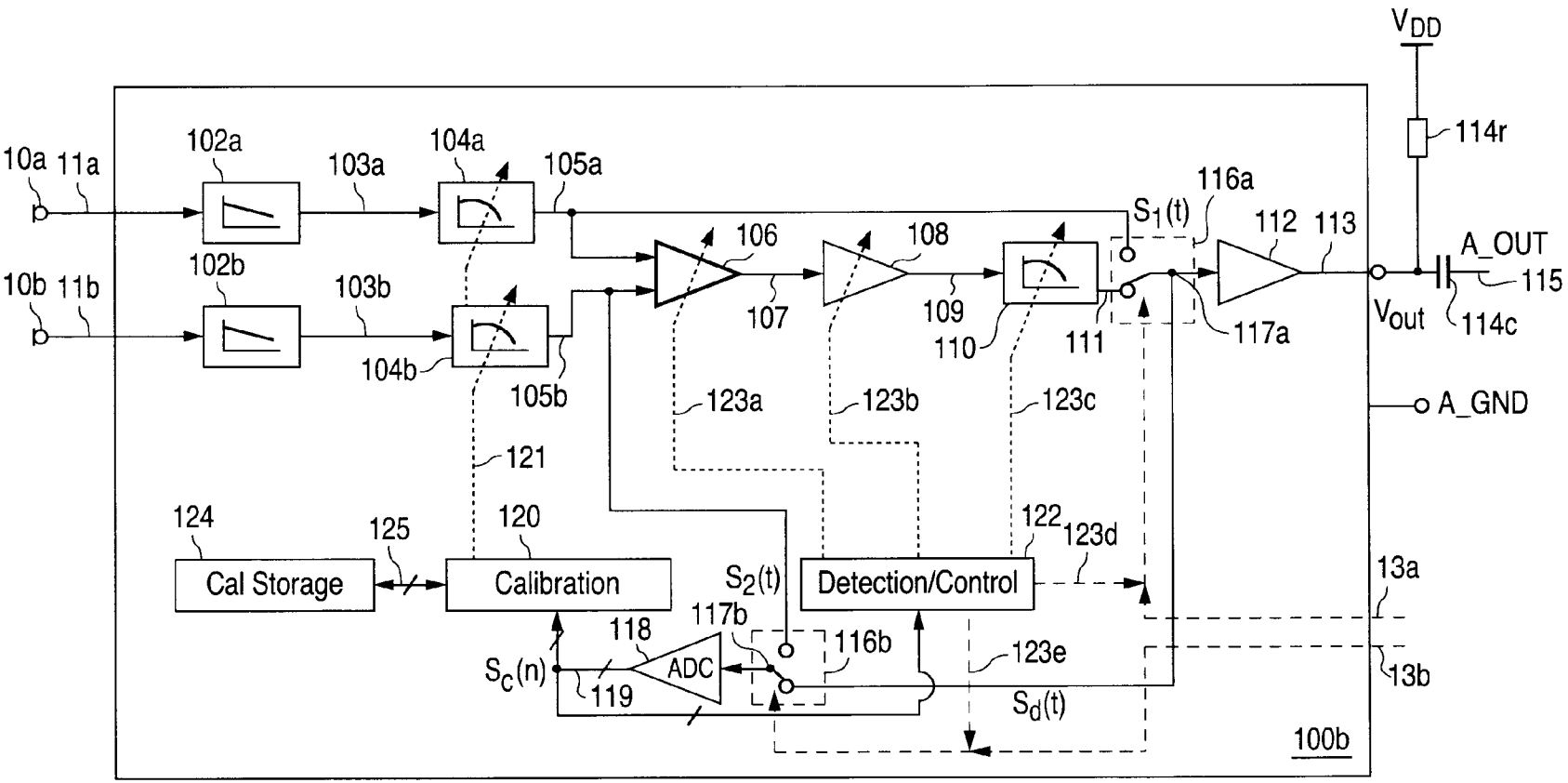
FIG. 2 is a functional block diagram of adaptive amplifier circuitry for a microphone array in accordance with another embodiment of the presently claimed invention.

Referring to FIG. 2, adaptive amplifier circuitry 100*b* for a microphone array in accordance with another embodiment of the presently claimed invention includes input adaptive filter circuitry, signal combining circuitry, output adaptive filter circuitry, signal selection circuitry and feedback control circuitry, as discussed in more detail below, for processing the microphone signals 11*a* and 11*b* received from the acoustic transducers 10*a*, 10*b*, to produce the final audio output signal 113 which is high pass filtered by a shunt biasing resister 114*r* and series coupling capacitor 114*c*.

The transducer signals 11*a* and 11*b* are filtered by respective low pass pre-emphasis filters 102*a* 102*b*, following which the filtered signals 103*a*, 103*b* are matched with matching filter circuits 104*a*, 104*b* which are adaptively controlled by one or more control signals 121. The resulting signals 105*a*, 105*b* are combined in a signal combining circuit 106 which is adaptively controlled by one or more control signals 123*a*. As discussed in more detail below, this combining circuit 106 is adaptively controlled to be either a summing circuit, i.e., where the input signals 105*a*, 105*b* are summed, or a subtraction circuit in which one of the input signals 105*a*, 105*b* is subtracted from the other.

The resulting signal 107 is amplified by a variable gain amplifier circuit 108 which is adaptively controlled by one or more control signals 123*b*. The amplified signal 109 is filtered by a low pass filter circuit 110 which adaptively controlled by one or more control signals 123*c*. The filtered output signal 111 and one of the filtered input signals 105*a* are provided as input signals to one of the signal selection circuits (e.g., switch or multiplexor circuits) 116*a*. The selected signal 117*a* (discussed in more detail below) is further amplified by a driver amplifier circuit 112 to produce the final audio output signal 113. The signal selection circuits 116*a*, 116*b* are controlled by signals which can originate as control signals 123*d*, 123*e* from the detection and control circuitry 122, or as control signals 13*a*, 13*b* initiated by the user (discussed in more detail below).

The control circuitry includes calibration circuitry 120, detection and control circuitry 122, and calibration storage circuitry 124, and are preferably digital circuits. Accordingly, the feedback signals, i.e., the selected output signal 117*a* and one of the filtered input signals 105*b*, are provided as the two input signals to another signal selection circuit 116*b*, with the selected signal 117*b* being digitized by an analog-to-digital converter (ADC) circuit 118. The resulting one or more digital signals 119 are provided to the calibration circuitry 120 and the detection and control circuitry 122. As discussed in more detail below, based upon these signals 119, the calibration circuitry 120 provides the adaptive control signals 121 for the matching filters 104*a*, 104*b* and the detection control circuitry 122 provides the adaptive control signals 123*a*, 123*b*, 123*c* for the combining circuit 106, variable gain amplifier circuit 108 and adaptive filter circuit 110.

The use of the signal selection circuits 116*a*, 116*b* allow for the selective use of four different feedback signals by the calibration circuitry 120 and the detection and control circuitry 122; the first filtered microphone signal 105*a*; the second filtered microphone signal 105*b*; a differential signal, i.e., where the selected feedback signal 117*a* is the difference between the two filtered input signals 105*a*, 105*b* when the signal combining circuit 106 is operating as a signal subtraction circuit; and a summation signal, i.e., when the selected feedback 117*a* is the sum of the filtered input signals 105, 105*b* when the signal combining circuit 106 is operating as a signal summing circuit. Further, with such selectivity of feedback signals available, such an adaptive amplifier circuit 100 is particularly useful for higher order microphone arrays, e.g., where three or more microphones are used, thereby making calibration and adaptive control more complex.

Calibration can be done in either time domain energy integration or frequency domain spectrum matching. Accordingly, the adaptive input filters 104*a*, 104*b* can be simple high pass filters, with the controls being applied to the corner frequencies to achieve proper matching for the two input transducers signals 11*a*, 11*b*.

Referring to FIGS. 1 and 2, calibration parameters are stored in calibration storage circuitry 124 and provided via data signals 125 to the calibration circuitry 120, and can be updated during adaptive operation of the circuit 100. The detection and control circuitry 122 also receives a control signal 13 which allows more direct control by the user (discussed in more detail below).

Adaptive amplifier circuitry for a microphone array in accordance with the presently claimed invention reduces noise when operating in a quiet environment and boosts speech signals when the talker moves from a near to a far field location relative to the microphone array. This is achieved by setting the operating mode of the signal combining circuit 106 to a signal summation circuit. By adding the filtered input signals 105*a*, 105*b*, the output signal 107 is effectively doubled. However, doubling of the internal noise will not reduce the signal-to-noise ratio (SNR). Such a signal summation circuit is equivalent to a delay-sum beam former, which can also improve signal quality in terms of directivity of the speech source relative to the microphone array.

In the case of a quiet operating environment there is little or no external background noise. Accordingly, the speech quality is enhanced by summing the two input signals 105*a*, 105*b*. In the case of cross field adaptation i.e., when the talker moves to a far field location, all signals may effectively become cancelled, but a summation can boost the desired signal from certain directions.

Detection of a quiet operating environment is done by way of signal classification, and in particular, classifying the background noise level. This can be achieved using signal gap level detection (discussed in more detail below). Regarding detection of movement from near field to far field, differential ratio detection can be used to determine when the talker is in a far field location.

Operation of the differential array as a delay-sum beam former can be done adaptively by altering delay through one of the matching circuit, e.g., the matching circuit 104*a* for the signal 105*a* which is not fed back to the control circuitry 120, 122.

Signal gap detection can be done by integrating the signal energy, e.g., the signal energy of the filtered input signal 105*b* fed back to the control circuitry 120, 122, and evaluating the occurrences and duration of signal gaps. For example, the control circuitry 120, 122 can look for signal gaps of 5-20 milliseconds. If such signal gaps are seen a predetermined number of times N1 (e.g., 100 gaps) within a predetermined time interval T1 (e.g., 5 seconds), then the signal combining circuit 106 is operated as a signal summation circuit for at least another predetermined time interval T2 (e.g., at least 10 seconds). The signal combining circuit 106 is then switched back to a signal subtraction mode of operation when the signal gaps occur less than another predetermined number of times N2 (e.g., 10 times) within the original time interval T1.

For detection of the far field talker, the signal combining circuit 106 is operated as a signal subtraction circuit, thereby allowing a comparison of the values between direct feedback signal 105*b* and the differential feedback signal 111 which will be indicative of no near field signal. In the case of a speakerphone application, a user control signal 13 can provide for direct, or manual, switching to a far field mode of operation, which causes the signal combining circuit 106 to operate as a signal summing circuit.

Various other modifications and alternations in the structure and method of operation of this invention will be apparent to those skilled in the art without departing from the scope and the spirit of the invention. Although the invention has been described in connection with specific preferred embodiments, it should be understood that the invention as claimed should not be unduly limited to such specific embodiments. It is intended that the following claims define the scope of the present invention and that structures and methods within the scope of these claims and their equivalents be covered thereby.

What is claimed is:

1. An apparatus including adaptive amplifier circuitry for a microphone array, comprising:

input adaptive filter circuitry responsive to one or more input control signals and a plurality of analog microphone signals by providing a corresponding number of filtered input signals;

signal combining circuitry coupled to said input adaptive filter circuitry and responsive to one or more combining control signals and said number of filtered input signals by providing a resultant signal selectively corresponding to one of a sum of at least a portion of said number of filtered input signals, and a difference between at least first and second ones of said number of filtered input signals;

output adaptive filter circuitry coupled to said signal combining circuitry and responsive to one or more output control signals and said resultant signal by providing an output signal; and feedback control circuitry coupled to said input adaptive filter circuitry, said signal combining circuitry and said output adaptive filter circuitry, and responsive to at least one of said number of filtered input signals and said output signal by providing said one or more input control signals, said one or more combining control signals and said one or more output control signals.

2. The apparatus of claim 1, wherein said input adaptive filter circuitry comprises a plurality of filter circuits each of which includes a plurality of serially coupled filter subcircuits, wherein at least one of said plurality of serially coupled filter subcircuits has a variable signal frequency response controlled by at least one of said one or more input control signals.

3. The apparatus of claim 1, wherein said signal combining circuitry comprises differential amplifier circuitry controlled by at least one of said one or more combining control signals to provide a selectable signal inversion for at least one of said number of filtered input signals.

4. The apparatus of claim 1, wherein said signal combining circuitry comprises differential amplifier circuitry controlled by at least one of said one or more combining control signals to provide:

a non-inverting signal gain for at least one of said number of filtered input signals; and an inverting signal gain for at least another one of said number of filtered input signals.

5. The apparatus of claim 1, wherein said output adaptive filter circuitry comprises:

amplifier circuitry with a variable signal gain controlled by at least one of said one or more output control signals; and filter circuitry serially coupled with said amplifier circuitry and having a variable signal frequency response controlled by at least one of said one or more output control signals.

6. The apparatus of claim 1, wherein said feedback control circuitry comprises:

first control circuitry coupled to said input adaptive filter circuitry and responsive to at least one of said number of filtered input signals and said output signal by providing said one or more input control signals; and second control circuitry coupled to said input adaptive filter circuitry, said signal combining circuitry and said output adaptive filter circuitry, and responsive to at least one of said number of filtered input signals and said output signal by providing said one or more combining control signals and said one or more output control signals.

7. An apparatus including adaptive amplifier circuitry for a microphone array, comprising:

input adaptive filter means for receiving one or more input control signals and in response thereto receiving and filtering a plurality of analog microphone signals to provide a corresponding number of filtered input signals;

signal combiner means for receiving one or more combining control signals and in response thereto receiving and combining said number of filtered input signals to provide a resultant signal selectively corresponding to one of a sum of at least a portion of said number of filtered input signals, and a difference between at least first and second ones of said number of filtered input signals;

output adaptive filter means for receiving one or more output control signals and in response thereto receiving and filtering said resultant signal to provide an output signal; and feedback controller means for receiving and processing at least one of said number of filtered input signals and said output signal to provide said one or more input control signals, said one or more combining control signals and said one or more output control signals.

8. An apparatus including adaptive amplifier circuitry for a microphone array, comprising:

input adaptive processing circuitry responsive to one or more input control signals and a plurality of analog microphone signals by providing a plurality of input processed signals corresponding to said plurality of analog microphone signals, and an intermediate processed signal selectively corresponding to one of a sum of at least a portion of said plurality of input processed signals, and a difference between at least first and second ones of said plurality of input processed signals;

output adaptive processing circuitry coupled to said input adaptive processing circuitry and responsive to one or more output control signals and said intermediate processed signal by providing an output processed signal; and feedback control circuitry coupled to said input and output adaptive processing circuitries, and responsive to at least one of said plurality of input processed signals and said output processed signal by providing said one or more input control signals and said one or more output control signals.

9. The apparatus of claim 8, wherein said input adaptive processing circuitry comprises a plurality of filter circuits, wherein at least one of said plurality of filter circuits is responsive to at least one of said one or more input control signals by filtering at least one of said plurality of analog microphone signals to provide at least one of said plurality of input processed signals with a variable signal frequency response controlled by said at least one of said one or more input control signals.

10. The apparatus of claim 8, wherein said input adaptive processing circuitry comprises differential amplifier circuitry responsive to at least one of said one or more input control signals by selectively inverting at least one of said plurality of input processed signals.

11. The apparatus of claim 8, wherein said input adaptive processing circuitry comprises differential amplifier circuitry responsive to at least one of said one or more input control signals by selectively providing:

a non-inverting signal gain for at least one of said plurality of input processed signals; and an inverting signal gain for at least another one of said plurality of input processed signals.

12. The apparatus of claim 8, wherein said input adaptive processing circuitry comprises:

a plurality of filter circuits, wherein at least one of said plurality of filter circuits is responsive to at least one of said one or more input control signals by filtering at least one of said plurality of analog microphone signals to provide at least one of said plurality of input processed signals with a variable signal frequency response controlled by said at least one of said one or more input control signals; and differential amplifier circuitry responsive to at least one of said one or more input control signals by selectively inverting at least one of said plurality of input processed signals.

13. The apparatus of claim 8, wherein said input adaptive processing circuitry comprises:

a plurality of filter circuits, wherein at least one of said plurality of filter circuits is responsive to at least one of said one or more input control signals by filtering at least one of said plurality of analog microphone signals to provide at least one of said plurality of input processed signals with a variable signal frequency response controlled by said at least one of said one or more input control signals; and differential amplifier circuitry responsive to at least one of said one or more input control signals by selectively providing a non-inverting signal gain for at least one of said plurality of input processed signals, and an inverting signal gain for at least another one of said plurality of input processed signals.

14. The apparatus of claim 8, wherein said output adaptive processing circuitry comprises:

amplifier circuitry responsive to at least one of said one or more output control signals by amplifying said intermediate processed signal with a variable signal gain controlled by said at least one of said one or more output control signals; and filter circuitry serially coupled with said amplifier circuitry and responsive to at least one of said one or more output control signals by filtering said intermediate processed signal with a variable signal frequency response controlled by said at least one of said one or more output control signals.

15. The apparatus of claim 8, wherein said feedback control circuitry comprises:

first control circuitry coupled to said input adaptive processing circuitry and responsive to at least one of said plurality of input processed signals and said output processed signal by providing said one or more input control signals; and second control circuitry coupled to said input adaptive processing circuitry and said output adaptive processing circuitry, and responsive to at least one of said plurality of input processed signals and said output processed signal by providing said one or more output control signals.

16. An apparatus including adaptive amplifier circuitry for a microphone array, comprising:

input adaptive processor means for receiving one or more input control signals and in response thereto receiving and processing a plurality of analog microphone signals to provide a plurality of input processed signals corresponding to said plurality of analog microphone signals, and an intermediate processed signal selectively corresponding to one of a sum of at least a portion of said plurality of input processed signals, and a difference between at least first and second ones of said plurality of input processed signals;

output adaptive processor means for receiving one or more output control signals and in response thereto receiving and processing said intermediate processed signal to provide an output processed signal; and feedback controller means for receiving and processing at least one of said plurality of input processed signals and said output processed signal to provide said one or more input control signals and said one or more output control signals.

17. An apparatus including adaptive amplifier circuitry for a microphone array, comprising:

input adaptive filter circuitry responsive to one or more input control signals and a plurality of analog microphone signals by providing a corresponding number of filtered input signals;

signal combining circuitry coupled to said input adaptive filter circuitry and responsive to one or more combining control signals and said number of filtered input signals by providing a resultant signal selectively corresponding to one of a sum of at least a portion of said number of filtered input signals, and a difference between at least first and second ones of said number of filtered input signals;

output adaptive filter circuitry coupled to said signal combining circuitry and responsive to one or more output control signals and said resultant signal by providing an output signal;

signal selection circuitry coupled to said input adaptive filter circuitry and said output adaptive filter circuitry, and responsive to one or more selection control signals by conveying, as a selected signal, one of said output signal, and a first one of said number of filtered input signals; and feedback control circuitry coupled to said input adaptive filter circuitry, said signal combining circuitry, said output adaptive filter circuitry and said signal selection circuitry, and responsive to said selected signal by providing said one or more input control signals, said one or more combining control signals and said one or more output control signals.

18. The apparatus of claim 17, wherein said input adaptive filter circuitry comprises a plurality of filter circuits each of which includes a plurality of serially coupled filter subcircuits, wherein at least one of said plurality of serially coupled filter subcircuits has a variable signal frequency response controlled by at least one of said one or more input control signals.

19. The apparatus of claim 17, wherein said signal combining circuitry comprises differential amplifier circuitry controlled by at least one of said one or more combining control signals to provide a selectable signal inversion for at least one of said number of filtered input signals.

20. The apparatus of claim 17, wherein said signal combining circuitry comprises differential amplifier circuitry controlled by at least one of said one or more combining control signals to provide:

a non-inverting signal gain for at least one of said number of filtered input signals; and an inverting signal gain for at least another one of said number of filtered input signals.

21. The apparatus of claim 17, wherein said output adaptive filter circuitry comprises:

amplifier circuitry with a variable signal gain controlled by at least one of said one or more output control signals; and filter circuitry serially coupled with said amplifier circuitry and having a variable signal frequency response controlled by at least one of said one or more output control signals.

22. The apparatus of claim 17, wherein said feedback control circuitry comprises:

first control circuitry coupled to said input adaptive filter circuitry and said signal selection circuitry, and responsive to said selected signal by providing said one or more input control signals; and second control circuitry coupled to said signal selection circuitry, said signal combining circuitry and said output adaptive filter circuitry, and responsive to said selected signal by providing said one or more combining control signals and said one or more output control signals.

23. An apparatus including adaptive amplifier circuitry for a microphone array, comprising:

input adaptive filter means for receiving one or more input control signals and in response thereto receiving and filtering a plurality of analog microphone signals to provide a corresponding number of filtered input signals;

signal combiner means for receiving one or more combining control signals and in response thereto receiving and combining said number of filtered input signals to provide a resultant signal selectively corresponding to one of a sum of at least a portion of said number of filtered input signals, and a difference between at least first and second ones of said number of filtered input signals;

output adaptive filter means for receiving one or more output control signals and in response thereto receiving and filtering said resultant signal to provide an output signal;

signal selector means for receiving one or more selection control signals and in response thereto conveying, as a selected signal, one of said output signal, and a first one of said number of filtered input signals; and feedback controller means for receiving said selected signal and in response thereto providing said one or more input control signals, said one or more combining control signals and said one or more output control signals.

24. An apparatus including adaptive amplifier circuitry for a microphone array, comprising:

input adaptive processing circuitry responsive to one or more input control signals and a plurality of analog microphone signals by providing a plurality of input processed signals corresponding to said plurality of analog microphone signals, and an intermediate processed signal selectively corresponding to one of a sum of at least a portion of said plurality of input processed signals, and a difference between at least first and second ones of said plurality of input processed signals;

output adaptive processing circuitry coupled to said input adaptive processing circuitry and responsive to one or more output control signals and said intermediate processed signal by providing an output processed signal;

signal selection circuitry coupled to said input and output adaptive processing circuitries, and responsive to one or more selection control signals by conveying, as a selected signal, one of said output processed signal, and one of said plurality of input processed signals; and feedback control circuitry coupled to said input and output adaptive processing circuitries and said signal selection circuitry, and responsive to said selected signal by providing said one or more input control signals and said one or more output control signals.

25. The apparatus of claim 24, wherein said input adaptive processing circuitry comprises a plurality of filter circuits, wherein at least one of said plurality of filter circuits is responsive to at least one of said one or more input control signals by filtering at least one of said plurality of analog microphone signals to provide at least one of said plurality of input processed signals with a variable signal frequency response controlled by said at least one of said one or more input control signals.

26. The apparatus of claim 24, wherein said input adaptive processing circuitry comprises differential amplifier circuitry responsive to at least one of said one or more input control signals by selectively inverting at least one of said plurality of input processed signals.

27. The apparatus of claim 24, wherein said input adaptive processing circuitry comprises differential amplifier circuitry responsive to at least one of said one or more input control signals by selectively providing:

a non-inverting signal gain for at least one of said plurality of input processed signals; and an inverting signal gain for at least another one of said plurality of input processed signals.

28. The apparatus of claim 24, wherein said input adaptive processing circuitry comprises:

a plurality of filter circuits, wherein at least one of said plurality of filter circuits is responsive to at least one of said one or more input control signals by filtering at least one of said plurality of analog microphone signals to provide at least one of said plurality of input processed signals with a variable signal frequency response controlled by said at least one of said one or more input control signals; and differential amplifier circuitry responsive to at least one of said one or more input control signals by selectively inverting at least one of said plurality of input processed signals.

29. The apparatus of claim 24, wherein said input adaptive processing circuitry comprises:

a plurality of filter circuits, wherein at least one of said plurality of filter circuits is responsive to at least one of said one or more input control signals by filtering at least one of said plurality of analog microphone signals to provide at least one of said plurality of input processed signals with a variable signal frequency response controlled by said at least one of said one or more input control signals; and differential amplifier circuitry responsive to at least one of said one or more input control signals by selectively providing a non-inverting signal gain for at least one of said plurality of input processed signals, and an inverting signal gain for at least another one of said plurality of input processed signals.

30. The apparatus of claim 24, wherein said output adaptive processing circuitry comprises:

amplifier circuitry responsive to at least one of said one or more output control signals by amplifying said intermediate processed signal with a variable signal gain controlled by said at least one of said one or more output control signals; and filter circuitry serially coupled with said amplifier circuitry and responsive to at least one of said one or more output control signals by filtering said intermediate processed signal with a variable signal frequency response controlled by said at least one of said one or more output control signals.

31. The apparatus of claim 24, wherein said feedback control circuitry comprises:

first control circuitry coupled to said input adaptive processing circuitry and said signal selection circuitry, and responsive to said selected signal by providing said one or more input control signals; and second control circuitry coupled to said signal selection circuitry and said output adaptive processing circuitry, and responsive to said selected signal by providing said one or more output control signals.

32. An apparatus including adaptive amplifier circuitry for a microphone array, comprising:

input adaptive processor means for receiving one or more input control signals and in response thereto receiving and processing a plurality of analog microphone signals to provide a plurality of input processed signals corresponding to said plurality of analog microphone signals, and an intermediate processed signal selectively corresponding to one of a sum of at least a portion of said plurality of input processed signals, and a difference between at least first and second ones of said plurality of input processed signals;

output adaptive processor means for receiving one or more output control signals and in response thereto receiving and processing said intermediate processed signal to provide an output processed signal;

signal selector means for receiving one or more selection control signals and in response thereto conveying, as a selected signal, one of said output processed signal, and one of said plurality of input processed signals; and feedback controller means for receiving said selected signal and in response thereto providing said one or more input control signals and said one or more output control signals.

* * * * *